US006119598A

United States Patent [19]

Reynolds et al.

[11] Patent Number: 6,119,598

[45] Date of Patent: Sep. 19, 2000

[54] APPARATUS AND METHOD FOR THERMOGRAPHIC PRINTING

[75] Inventors: Michael G. Reynolds, Califon; Anthony F. Urgola, Manasquan, both of N.J.

[73] Assignee: Faust Thermographic Supply, Inc., Linden, N.J.

[21] Appl. No.: 09/080,292

[22] Filed: May 18, 1998

[51] Int. Cl.[7] ..... B05D 5/00

[52] U.S. Cl. ..... 101/488; 118/308; 118/312; 427/197; 427/202; 219/216

[58] Field of Search ..... 101/488; 118/308, 118/310, 312, 58; 427/197, 202, 270; 219/216, 388; 400/201; 399/223, 227

[56] References Cited

U.S. PATENT DOCUMENTS

| | | | |
|---|---|---|---|
| 537,923 | 4/1895 | Hildyard . | |
| 1,739,492 | 12/1929 | Berndt et al. | 101/488 |
| 2,049,495 | 8/1936 | Freuder | 101/119 |
| 2,334,909 | 11/1943 | Darenberg et al. | 101/115 |
| 3,207,897 | 9/1965 | Limberger | 101/488 |
| 3,613,635 | 10/1971 | Brehm | 118/406 |
| 3,911,160 | 10/1975 | Neuberg | 101/491 |
| 4,101,688 | 7/1978 | Kurtzman | 427/198 |
| 4,805,531 | 2/1989 | Sarda | 101/488 |
| 5,098,739 | 3/1992 | Sarda | 427/197 |
| 5,699,743 | 12/1997 | Ganz et al. | 101/488 |
| 5,713,275 | 2/1998 | Imai | 101/119 |

*Primary Examiner*—John S. Hilten
*Assistant Examiner*—Leslie J. Grohusky
*Attorney, Agent, or Firm*—Pennie & Edmonds LLP

[57] ABSTRACT

A thermographic printing apparatus, and method for thermographic printing, including a header assembly having at least two rollers for transporting a substrate having first and second sides, two edges, and powder adhering liquid on the first side thereof through the apparatus, wherein the rollers contact the substrate on the second side thereof, at least two disks each having an edge for transferring the substrate between each roller and the disks, wherein the disks position the substrate adjacent the edge thereof to provide at least one substantially contained area within the disks and substrate, and a powder supply for providing powder particles into the at least one contained area for application to the first side of the substrate, whereby an amount of the particles provided into the contained areas adheres to the powder adhering liquid on the substrate.

23 Claims, 7 Drawing Sheets

APPARATUS AND METHOD FOR THERMOGRAPHIC PRINTING

FIELD OF THE INVENTION

The invention relates to an apparatus and method for high speed thermographic printing on a substrate, where the apparatus has a plurality of cylindrical disks having holes therein which emit jets of gas to float a web of printing substrate thereon to facilitate the scattering and deposition of thermographic powder on the substrate prior to heating and setting of the powder.

BACKGROUND OF THE INVENTION

Many printers have discovered that thermography can add another dimension to their business. Thermography today is no longer just for stationery, business cards and announcements, but has emerged as an art form in its own right. Used on its own, or as an adjunct to lithography, foil stamping, embossing and silk screening, it has become an extremely useful tool for graphic designers and artists. Other applications include greeting cards, labels, tags, annual reports, report covers, packaging and posters.

Thermography is an established procedure whereby raised printing that imitates copper plate engraving or stamping from any type of printing process is more easily accomplished using an offset or other conventional printing process. Printed sheets from a conventional printing press drop onto a conveyer where a resin or powder, having the characteristic of melting under the effect of heat, is vibrated onto them. Excess powder may be continuously removed by vacuum suction or by hand and recycled, except where the powder has adhered to the wet ink. The printed and powdered sheet then typically passes through a tunnel-type oven, where it is heated to melt and fuse the powder grains into a raised film. At the exit, cold air is blown onto the sheet to cool and set the viscous raised film so as to prevent sheets from sticking together or smearing. Two examples of such thermographic printing procedures are U.S. Pat. Nos. 5,699,743 and 5,098,739.

It is known in the art that the granule size of the powder used in part determines the thickness of the relief film, or raised print, up to a certain maximum height. Larger powder granules are used to obtain greater heights of raised print. Thermographic raised print on the order of 0.01 inches in height may be obtained according to the methods taught by U.S. Pat. No. 5,699,743 by printing an ink line about 1/16 to 1/8 inch in width, depositing 20 to 50 mesh powder thereon, and heating at the appropriate time and temperature to fuse the powder without completely melting it. Generally, smaller particle sizes of powder are used when lesser heights of the raised print are desired.

There are two distinct types of thermographic powder generally used: transparent and opaque. Transparent powders generally include high gloss, semi-gloss, and semi-dull. Opaque powders typically include metallics, such as gold, silver, and bronze; white; and the relatively new pearlized powder. High gloss is the most commonly used powder for all thermographic applications.

There are five conventional granulations for use on lines ranging in thickness from "fine line" to "heavy solids." Fine lines require the finest granulation typically described as fine as flour, while heavy solids require a coarser granulation typically described as loose as sugar. Semi-gloss, dull and semi-dull powders are primarily selected by designers looking for special effects. They generally provide less shine than the high gloss powders, but retain a similar "feel" and raise. The metallic and white opaque powders, on the other hand, are typically difficult to work with. Thus, thermography shops generally run only high gloss powders.

Thermographic printing has typically been achieved by printing wet ink on a substrate using flat conveying devices to move the printing substrates (e.g., sheets of paper) under a hopper that drops powder thereon. Conventional thermographic printing over the last 100 years or so has typically only been able to achieve printing speeds of 60–70 ft/min. and occasionally as high as 100 ft/min., although it is unclear if this speed can be maintained on a continuous basis. Moreover, the thermographically printable area has been limited to approximately 12 inches in width. Reports have been made of printable widths on the order of up to 20 inches. Offset and other types of conventional printing often have used a cylindrical printing apparatus that may permit higher printing speeds. The apparatuses used in several conventional flat printing and flat color printing on paper and fabrics are described as follows.

U.S. Pat. No. 537,923 discloses an apparatus for producing designs on paper having a stencil sheet cut with the pattern of the desired design, vessel(s) for holding and delivering the inks or colors, and a blast apparatus for delivering the inks or colors through the stencil sheet to come into contact with the paper or other surface upon which the design is desired.

U.S. Pat. No. 2,049,495 discloses a printing apparatus for continuously replenishing a supply of ink to a material which is to be imprinted. The ink supply is provided from within a cellular cylinder to fill the pattern running along the sealing surface of the cylinder.

U.S. Pat. No. 2,334,909 discloses a press roller to print on fabric at relatively high speeds by supplying ink of different colors to the interior side of a stencil, which has openings through which the ink passes to print on the fabric. Also disclosed is an ink or color holder in contact with the stencil that permits the loader to be filled externally from the press and swung into the color holder without the need to stop the press.

U.S. Pat. No. 3,613,635 discloses a spot printing apparatus for printing a powder onto a substrate including a perforated hollow roller, means for rotating the roller, and a hopper means within the roller for holding the powder. The perforated hollow roller has a discontinuous pattern of holes for depositing the dry powder.

U.S. Pat. No. 5,713,275 discloses a stencil printing machine having a holding device for holding the perforated stencil sheet, an ink supply device, a printing sheet conveying device, and an air ejection means for ejecting air to the stencil sheet from within and causing the ink to pass through the image on the stencil sheet and transfer to the printing sheet.

These conventional printing devices are generally directed to printing flat patterns or text on fabrics or paper. It was believed that cylindrical rollers were not suitable for the powdering stage of thermographic printing for various reasons, e.g., loose powder on the substrate would be more likely to smear. As thermographic printing has gained commercial success in various printing endeavors, however, it has become desired to improve the efficiency and quality of thermographic printed products. Thus, it is desired to have an apparatus capable of providing a thermographic printed product that is capable of high speed use and has multiple colors on different parts of the product while still maintaining the high quality achieved by conventional thermographic printing.

SUMMARY OF THE INVENTION

The present invention relates to a thermographic printing apparatus having a header assembly having at least two rollers for transporting through the apparatus a substrate having first and second sides, two edges, and a powder adhering liquid located on the first side thereof, wherein the rollers contact the substrate on the second side thereof, at least two disks each having an edge for transferring the substrate between the rollers, wherein the disks position the substrate adjacent the edge thereof to provide at least one substantially contained area between the disks and substrate, and a powder supply for providing powder particles into at least one contained area for application to the first side of the substrate, whereby an amount of the particles provided into the contained areas adheres to the liquid on the substrate.

In one embodiment, the apparatus further includes a gas supply in the header assembly directed at the first side of the substrate for removing excess powder particles from the substrate to avoid smearing of the liquid or powder particles on the substrate. In a preferred embodiment, the header assembly is configured to permit the substrate to move continuously through the apparatus.

In another embodiment, each edge of the substrate is positioned adjacent a corresponding edge of a disk. In another embodiment, the apparatus further includes at least one additional disk located between the two disks to separate the contained area into at least two separate substantially contained areas to facilitate application of different powder types onto different portions of the substrate.

In yet another embodiment, each disk has an edge that includes holes therein to emit a gas at a sufficient velocity to prevent direct contact of the substrate with the disk edge. In a preferred embodiment, the disk edge holes have a diameter from about 0.001 to 0.5 inches and are spaced apart by about 0.25 to 3 inches. In a more preferred embodiment, the holes have a diameter from about 0.01 to 0.05 inches and are spaced apart by about 0.75 to 1.5 inches. In another preferred embodiment, the disks are substantially circular. In one embodiment, each disk has a diameter from about 12 to 60 inches and a thickness from about 0.25 to 6 inches. In a preferred embodiment, disk has a diameter from about 24 to 36 inches and a thickness from about 1 to 3 inches.

In another embodiment, the gas is maintained at a pressure from about 15 psi to 120 psi for release from the holes. In yet another embodiment, the apparatus further includes a heating device located at a distance from the substrate having particles of powder and wet ink thereon, wherein the heating device is capable of adjustment to increase the distance from the substrate as the substrate speed is slowed, which inhibits burning of the substrate and imparts a substantially constant amount of heat to the substrate to melt and fuse the powder particles thereon. In a preferred embodiment, the heater contains a heat source disposed at a distance from about 0.1 to 2 inches from the substrate and the substrate is disposed between the powder and the heater. In another embodiment, the powder adhering liquid is an ink which is capable of drying as the substrate passes through the heating device. In yet another embodiment, the apparatus further includes at least one of a feed roller capable of providing substrate to the header assembly in a continuous fashion or a rewind spool capable of continuously receiving and rolling the substrate. In one embodiment, the header assembly has an intake roller and an output roller and the intake roller is disposed at an angle from about 1 to 80 degrees above the horizontal relative to the output roller to inhibit the loss of powder supply.

The invention also relates to a thermographic printing apparatus having means for transporting a substrate having first and second sides and wet ink on the first side thereof, wherein the means for transporting contacts the substrate on the second side of the substrate, means for positioning the substrate in the apparatus to provide at least one substantially contained area inside the means for positioning and the substrate, wherein the means for positioning does not contact the substrate, and means for providing powder particles for application to the first side of the substrate capable of adhering an amount of the particles to the wet ink on the substrate.

In one embodiment, the means for positioning includes at least two substantially circular disks having holes for emitting gas spaced around the circumferential edge thereof. In another embodiment, the apparatus further includes means for removing excess powder particles from the substrate sufficient to inhibit smearing of the wet ink or powder particles on the substrate.

The invention further relates to a method of thermographic printing by transporting a continuous substrate having first and second sides, two edges, and a powder adhering liquid on the first side thereof along a path, providing powder particles onto a portion of the first side of the substrate, whereby at least some of the powder particles adhere to the liquid on the substrate, and circulating the powder particles that do not adhere to the first portion of the substrate for application to further portions of the substrate.

In one embodiment, the substrate is directed along a substantially circular path and the non-adhering powder particles are positioned along the path adjacent the substrate for deposition onto further portions thereof. In another embodiment, the powder adhering liquid is an ink and which further includes removing excess powder particles from the substrate before the powder coated substrate is heated.

BRIEF DESCRIPTION OF THE DRAWINGS

Further features and advantages of the invention can be ascertained from the following detailed description, which is provided in connection with the attached drawings, wherein.

DESCRIPTION OF THE PREFERRED EMBODIMENTS

A suitable web apparatus for high speed thermographic printing has now been discovered. A preferred use for this apparatus is for depositing particles of thermographic powder on a continuous printing substrate, such as a roll of paper, that has a powder adhering liquid, such as an ink, placed thereon in the form of a pattern or printed image. The apparatus advantageously permits a wet ink substrate to have powder placed thereon in a continuous fashion. Moreover, the present invention provides a powdering device that permits different color and size powders to be rapidly placed onto various portions of the substrate, also in a continuous fashion. This is accomplished by a powdering device that contains a plurality of disks which are hollow and which have holes in the circumferential edges thereof to permit the substrate to float around the disks on a wave of air, thereby inhibiting the smearing of any wet ink or powders during the powdering of the substrate. These disks, in connection with the substrate, form contained areas in which powder particles are placed for application to the wet ink on the substrate, which is continuously fed through the powdering device. The powder is more readily distributed onto the wet ink areas on the substrate due to the constant substrate movement around the disks. Excess powder is removed by a combination of an air knife, or blast of gas, and gravity in the powdering device to prevent smearing of the powder to provide a consistent quality final thermographic product. The powdering device contains the powder particles to prevent their escape, which also advantageously inhibits contamination of the surrounding air and permits powder to be readily recycled for application to the substrate.

Figure 1:
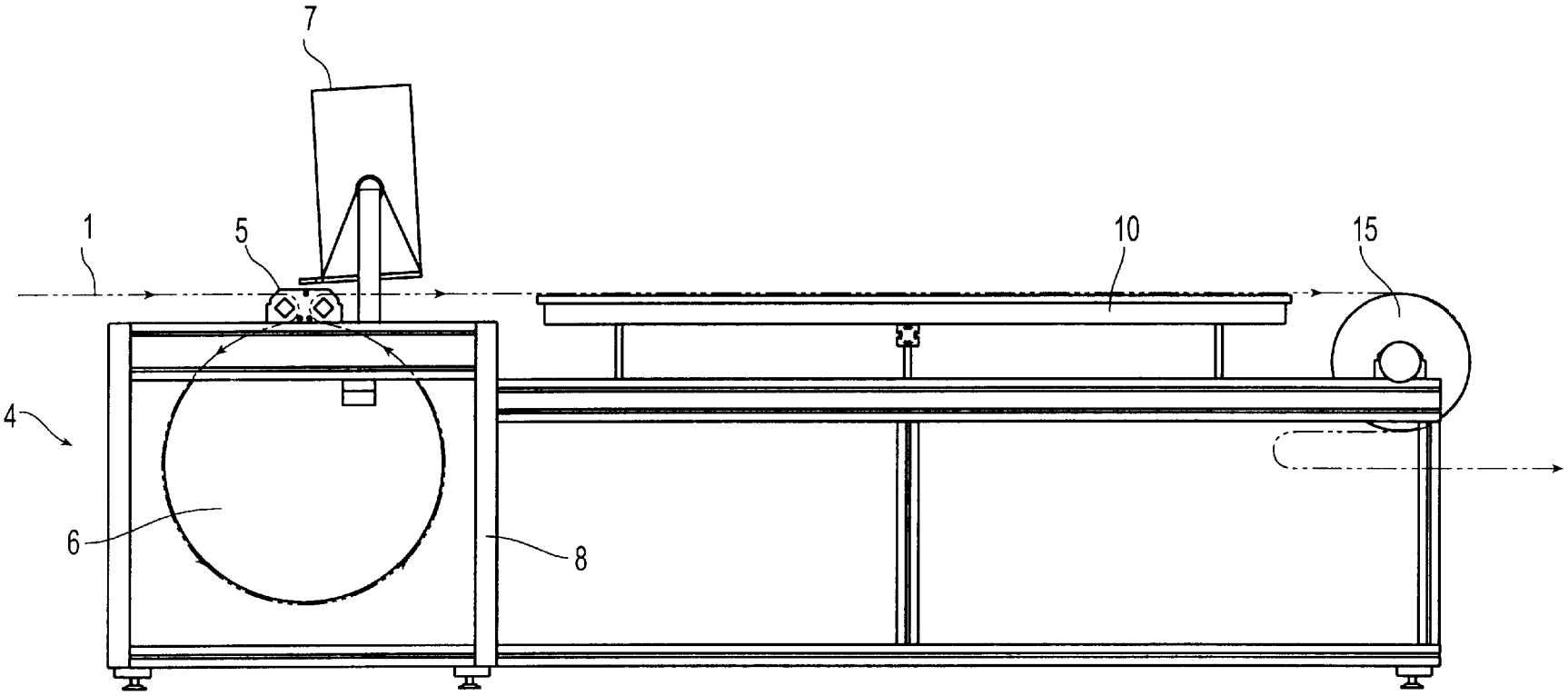
FIG. 1 illustrates an overview of the web apparatus including the powdering device of the invention.

FIG. 1 shows an overview of the web apparatus of the present invention. A substrate 1 having two sides to be provided with thermographic print on one side is provided in continuous form, e.g., as a roll or web of paper, from a press that places wet ink onto one side of the substrate (not shown). The substrate may be of any size desired, but preferably has a width from about 8 to 60 inches, preferably about 12 to 48 inches, more preferably about 24 to 36 inches. The substrate may have any thickness up to about ¼ inch, although thicker substrate stock is less likely to be flexible enough to flow smoothly around the disks in the powdering device. The substrate may be sheets of substrate having sufficient length to completely enclose the circumference of the disks. Preferably, however, a long substrate material having the width described above is used to permit the high speed application of thermographic powder to the substrate. Substrate is typically provided in rolls, such as rolls of paper, although the substrate supply is not a critical aspect of the invention. Although paper is the preferred substrate, any other sheet materials which can withstand the heat of the thermographic process can be used, including cardboard, fabric, and certain plastics.

The substrate 1, having passed through a press or other source of powder adhering liquid (not depicted), has already received a supply of the liquid, which may be of any color including clear, that has not yet fully dried. The substrate 1 enters the powdering device 4 of the present invention through the header assembly 5 and passes around two or more powder-retaining disks 6 that are disposed below the header assembly. It should be noted that the powdering device 4 depicted in FIG. 1 has a frame 8 that supports the powdering device 4. The frame is not a crucial feature of the invention, and in another embodiment (not shown) the powdering device 4 may be mounted on two oppositely facing walls, for example. Only the area of one disk is depicted in FIG. 1, as further discussion is set forth below. The powdering device 4 contains a powder hopper 7 that releases powder in measured quantities that are intended to stick to the wet ink on the substrate 1 as it moves around the disks and through the powdering device 4. The direction of the substrate along a circular path imparts a circular motion to the powder in the powdering device. Thus, any powder that does not deposit on the web ink is circulated through the device so that it can deposit on further portion of the substrate. As noted above, the amount of powder is metered into the device so that an excess of that necessary to coat the substrate is provided, as is generally understood by one of ordinary skill in the art.

The substrate 1 then exits the powdering device 4 and passes through a heater 10 that fuses the powder on the substrate 1 to form raised thermographic print. The substrate 1 then passes through a cooler 15 that chills the powder of the print to solidify and inhibit smearing thereof. Suitable heating and cooling processes and apparatuses are well known to those of ordinary skill in the art, and the substrate 1 may be subsequently passed to further conventional post-processing operations such as folding, cutting, or rolling up of the substrate, and the like.

Figure 2:
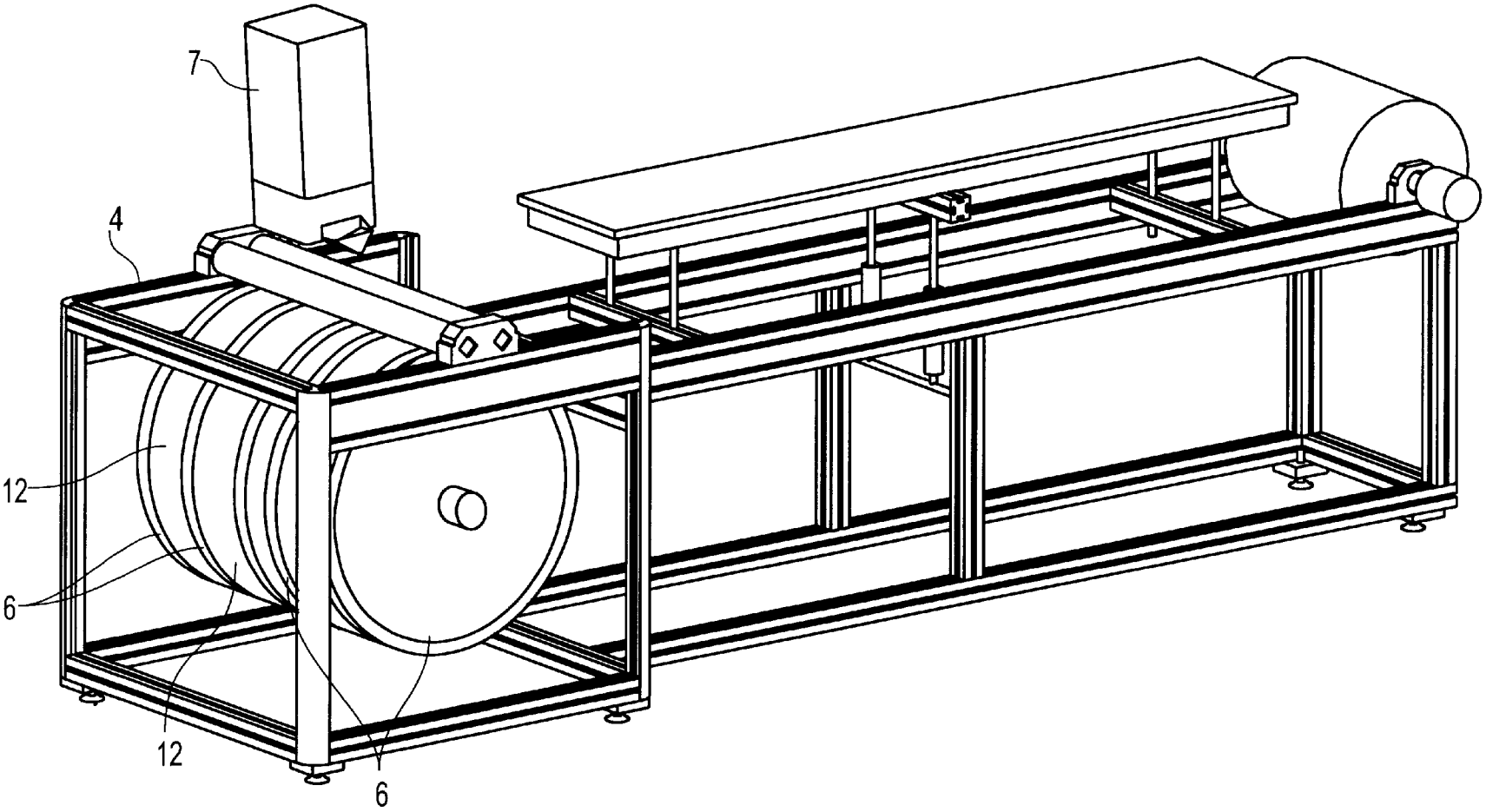
FIG. 2 illustrates a perspective view of the web apparatus including the powder-retaining disks according to the invention.

FIG. 2 shows a perspective view of the web apparatus that more clearly depicts a plurality of powder-retaining disks 6 in the powdering device 4. In this view, the substrate 1 is not depicted so as to provide a clear view of the disks 6. When the substrate is present, the disks 6 and substrate 1 form substantially contained areas 12 between each pair of disks 6. The only substantial opening in the contained areas 12 is at the top of the powdering device where the powder hopper 7 releases powder into the contained areas 12.

The powder hopper 7 is designed to be easily removed and replaced on the device so as to facilitate continuous operation. In certain situations, the size of the powder hopper can be selected to provide the appropriate amount of powder for the substrate. Generally, however, the hopper is sized so as to be easily manipulated by the operator for replacement as necessary as the powder is used. Instead of this hopper, it is possible to provide powder from a continuous supply, for example by introducing a fluidized stream of powder from a suitable air fluidizing device.

Figure 3:
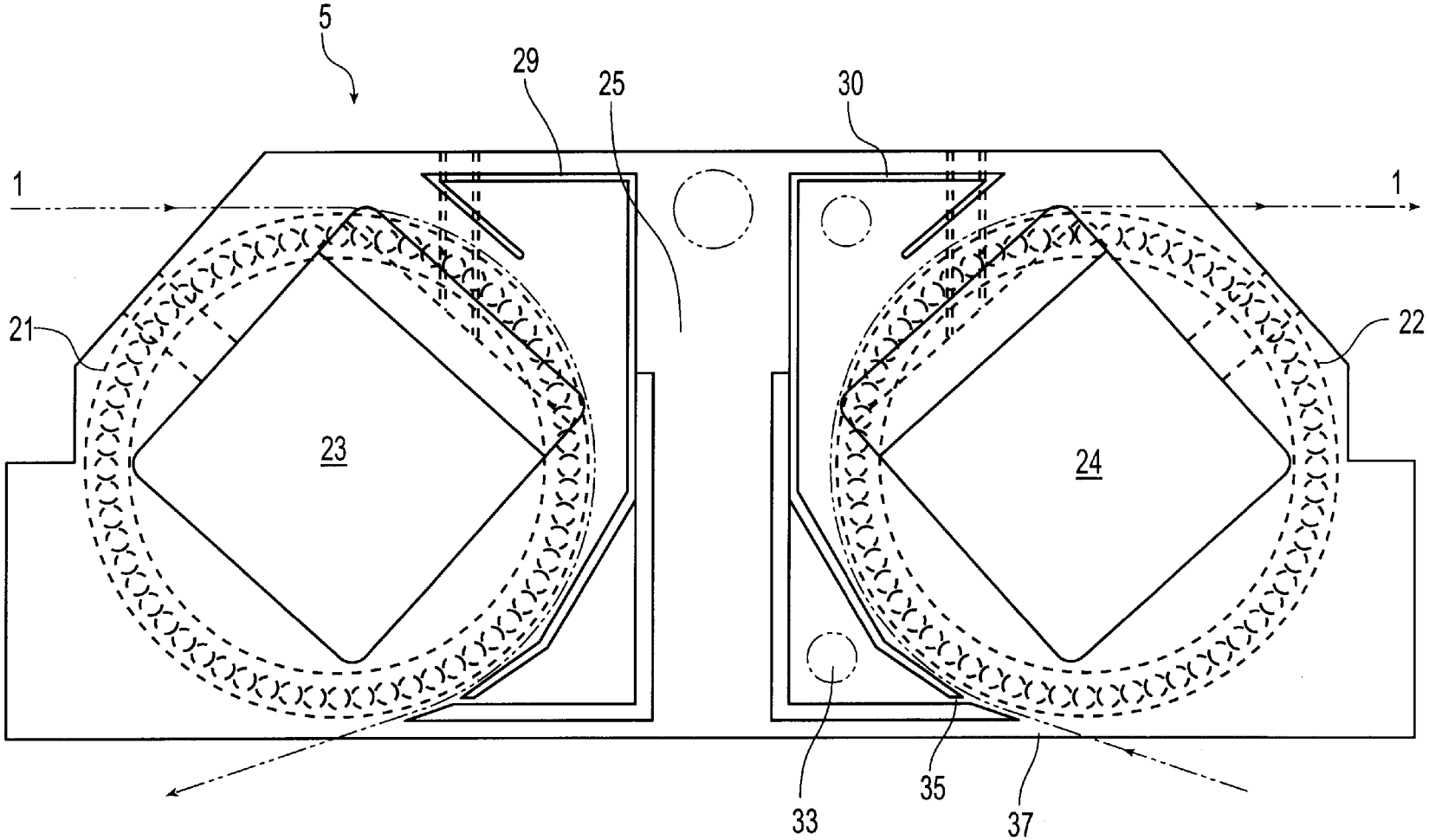
FIG. 3 illustrates a close-up view of the header assembly above the powdering device according to the invention.

FIG. 3 shows the header assembly 20 of the powdering device 4, which guides the substrate 1 around intake roller 21 and adjacent the disks 6 (not shown) of the powdering device. After passing around these disks 6 with the wet ink facing inward, the substrate 1 returns to the header assembly and passes around output roller 22. The rollers 21, 22 are preferably substantially cylindrical and may be powered to facilitate movement of the substrate 1 through the powdering device 4, although if other means to move the substrate are present at other points in the web apparatus then the rollers 21, 22 may be unpowered and act only to guide the substrate around the disks 6. For example, in one embodiment, the web is pulled through the entire printing apparatus from the output of the substrate, which advantageously keeps tension relatively smooth over portions of the web. Once the substrate 1 leaves the powdering device 4 through the header assembly 5, the substrate is then typically heated to fuse the thermographic powder retained on the wet ink during passage through the powdering device 4. The header assembly 5 also contains a powder passage 25 between the rollers 21, 22, which permits powder from the powder hopper 7 to be released into the contained areas 12.

FIG. 3 also depicts optional roller adjusters 23, 24 in connection with the rollers 21, 22, respectively, to alter the circumference or placement of the rollers as needed to modify the speed, tension, or location of the substrate 1 as it passes through the powdering device. The substrate may be passed through the machine at speeds from about 10 to 2000 ft/min., preferably from about 400 to 1500 ft/min., and more preferably 600 to 1000 ft/min. The housing 29, 30, used to partly surround rollers 21, 22, defines the size of the powder passage 25. As shown here, the housing 30 adjacent roller 22 includes a source of gas 33, typically pressurized air, that is directed through a gap 35 in the housing 30. Generally, excess powder particles 37 are not substantially in contact with the wet ink and are thus easier to dislodge from the substrate than powder particles that contact and adhere to the wet ink. This gap 35 directs the high pressure gas 33 onto the surface of the substrate 1 in a manner like an "air knife" that helps dislodge the excess thermographic powder particles 37 from the wet ink. The pressure of the air knife is generally from about 0 psi to 100 psi, preferably from about 1 psi to 80 psi, and more preferably from about 5 to 50 psi. The air knife pressure will depend upon the speed of the substrate 1, as higher speeds may be require less pressure to remove excess powder particles. The precise pressure may be readily determined by one of ordinary skill in the art. At this location of the powdering device, the powdered and inked side of the substrate is facing downward toward the disks. Thus, the pull of gravity also assists the high pressure gas 33 in removing excess powder particles from the substrate. Since the excess powder particles 37 are removed from the substrate 1 before the substrate 1 enters the header assembly 5, the particles 37 remain in the contained areas of the powdering device for continued application to substrate 1 containing wet ink but having insufficient powder particles. This air knife advantageously avoids the need for a cyclone, dust bag, vacuum or other mechanism to remove excess powder particles from the substrate, as is typically required in conventional thermographic processes. Advantageously, the path of the substrate changes direction when passing by the air knife to assist in the removal of excess powder therefrom. The excess powder returns to the contained area for application to further portions of the substrate.

Figure 3A:
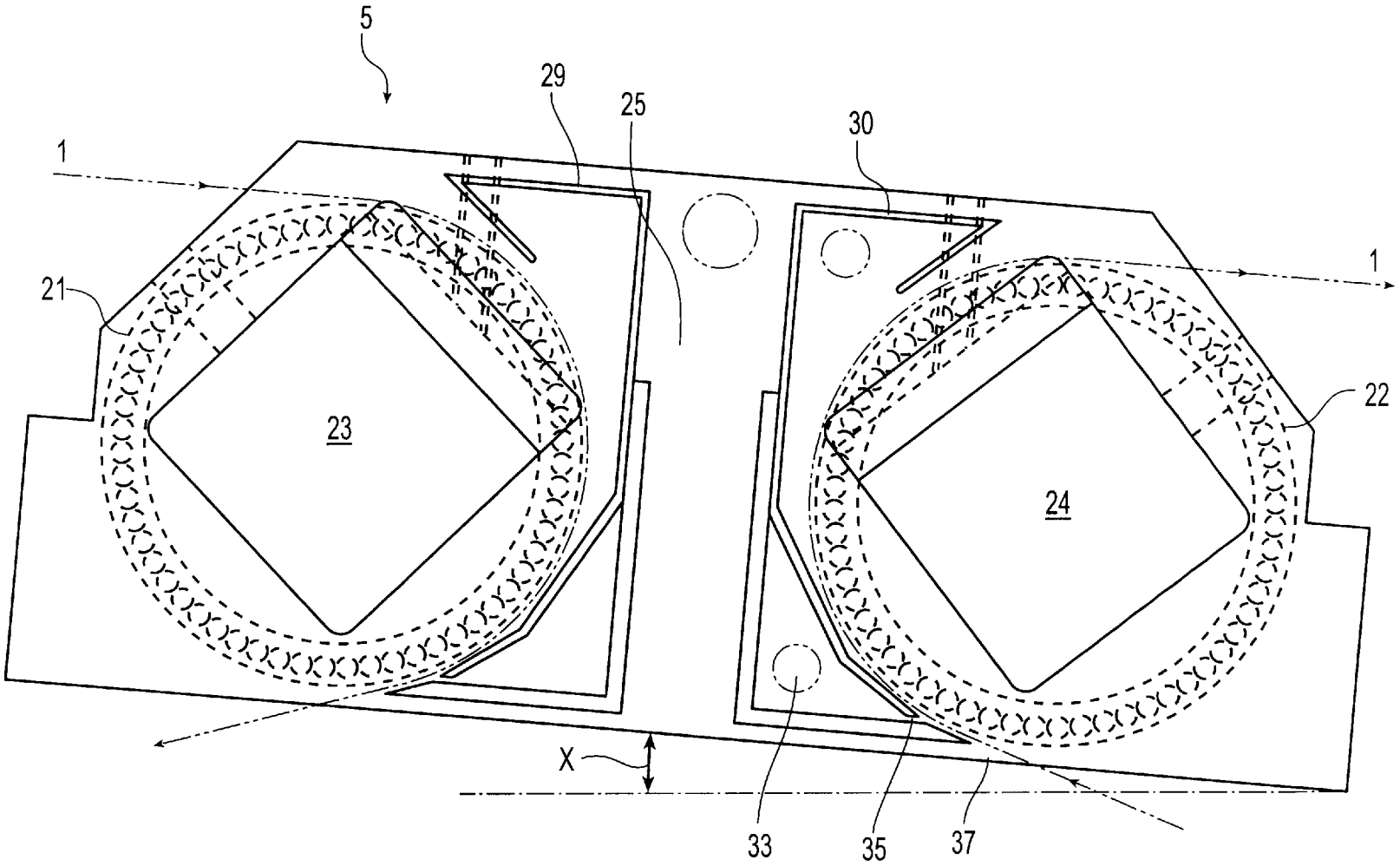
FIG. 3*a* illustrates a perspective view of the intake roller disposed at an angle relative to the horizontal of the output roller.

In the embodiment depicted in FIG. 3, an imaginary plane passes through the center of each roller in a horizontal fashion. In one preferred embodiment, intake roller 21 is disposed at a larger distance from the disks below than output roller 22 (see FIG. 3*a*). Thus, the substrate 1 enters the intake roller 21 at a height greater than when it leaves the output roller 22, so that the imaginary plane through the roller centers is inclined at an angle from between about 1 to 80 degrees, preferably from about 20 to 70 degrees, and more preferably from about 30 to 60 degrees from the horizontal plane in the embodiment depicted in FIG. 3. An exemplary placement of the rollers 21, 22 is to have the intake roller disposed to form about a 45° angle of the imaginary plane through the roller centers. By positioning the intake roller 21 above the output roller 22, the excess powder removed by the air knife is advantageously maintained in the powdering device and is less likely to exit the device through the header assembly 5. This increases the dwell time of the powder in the powdering device, which tends to improve the quality of the final thermographic product. It has also been found that the dwell time is longest when the disk diameters have a particular ratio to the substrate speed. It should be understood that the invention successfully operates with any ratio of disk diameter to substrate speed. The longest dwell times, however, were obtained by using disks having a diameter of about 6 inches for every about 100 feet/min. of linear substrate speed. Thus, a disk diameter of about 3 feet should be used for the highest quality thermographic printing of a substrate being printed upon at 600 feet/min.

Figure 4:
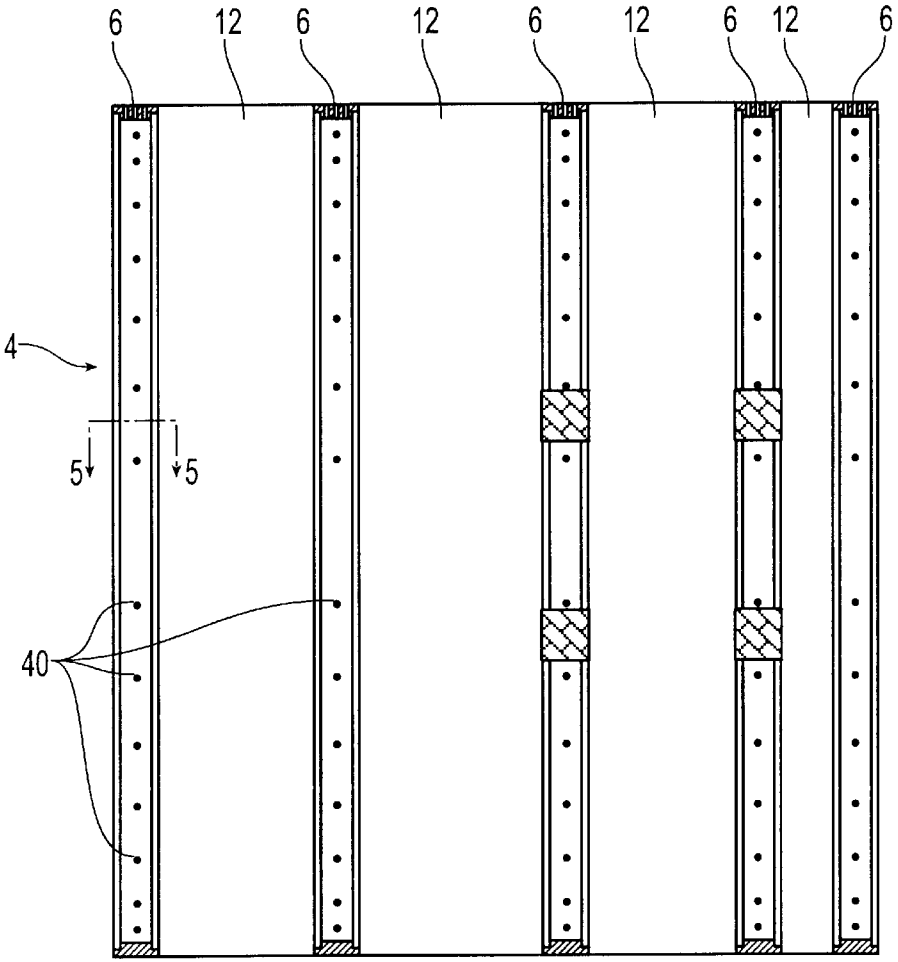
FIG. 4 illustrates a view of a vertical plane along a disk axis as viewed from the web feed according to the invention.

FIG. 4 shows a side view, more specifically, a section view on a disk's vertical plane along a disk axis as viewed from the web feed, of a plurality of powder-retaining disks 6 that are used to contain the loose powder in a plurality of contained areas 12 of the powdering device 4. The disks may be any shape having no sharp corners, although they are preferably substantially ellipsoidal, oval or circular. The disks are more preferably circular to promote smooth movement of the substrate over the disk edges and circulation of the excess powder therebetween. A diameter of about 12 to 60 inches, preferably from about 18 to 48 inches, more preferably from about 24 to 36 inches and a width from about 0.15 to 6 inches, preferably about 0.25 to 4 inches, and more preferably about 0.5 to 2 inches is used when circular disks are used. The width should be large enough to contain a passage within each disk for the gas that escapes from the holes 40 along the circumferential edge of each disk 6. It is also desired to use as narrow a disk as possible to keep the powdering areas as large as possible.

The contained areas inside the disk assemblies are preferably maintained at pressures from about 15 psi to 120 psi, more preferably from about 50 psi to 100 psi. This source of pressured air may be provided merely from the source of high pressure gas 33, gas flowing from the holes in the circumferential edges of the disks, the fluidized powder stream (when used), another independent high pressure gas source, or a combination thereof.

Powder released from the powder hopper 7 of FIGS. 1 and 2 or otherwise introduced into the device falls through the powder passage 25 of the header assembly 5 of FIG. 3 and into the contained areas 12 around which the substrate 1 is passed. The substrate 1 is passed over the edge of each disk 6. The substrate 1, although it could actually rest on the edge of the disks 6, preferably passes around the disks 6 while being kept slightly out of contact by gas being released from the edge of each disk 6. Maintaining the substrate away from the edge of each disk 6 advantageously inhibits smearing of the wet ink on the substrate that would tend to occur if the wet ink of the substrate were in contact with the disks 6.

Each disk 6 has a plurality of holes 40 in the circumferential edge thereof to permit the flow of gas from the disk 6 to facilitate maintenance of the substrate away from the edge of the disk 6. The gas flow may be supplied to each disk in a variety of ways. In one embodiment, tubing containing a continuously flowing pressurized gas feed is furnished into a hollow area within each disk 6 that contains the gas therein until the gas escapes from the holes 40. The tubing may be arranged to enter from the top of each disk, for example, through the header assembly of FIG. 3 and downward to hang in a hollow area inside each disk. The hollow area is thus pressurized and the gas flow escapes through the holes 40. In another embodiment depicted in FIG. 5, the tubing 42 supplying the pressurized gas enters each disk in the same fashion, but the tubing 42 is disposed about the inside of the circumferential edge 45 of the disk and is attached to the inside edge 45 of the disk. The tubing 42 has holes 40' spaced corresponding to the holes 40 in the edge of each disk 6, as discussed below, to permit the gas to flow into each disk 6 through the tubing 42 and directly out the holes 40' and 40 in the tubing 42 and each disk 6. This advantageously avoids the need to pressurize the entire hollow area 47 inside the disk 6, which reduces or eliminates air leakage problems that can undesirably reduce the gas pressure. If brittle materials are used to form the disk 6, a high pressure hollow area 47 therein can force the disk to explode. Avoiding pressurization of the hollow area thus also eliminates this potential problem of warping or shattering the disk 6. Regardless of how the gas supply is fed into the disks, each disk 6 may also have one or more supports 50, such as a pins, in the hollow area 47 to increase the structural integrity of the disk 6 from the inside.

Figure 5:
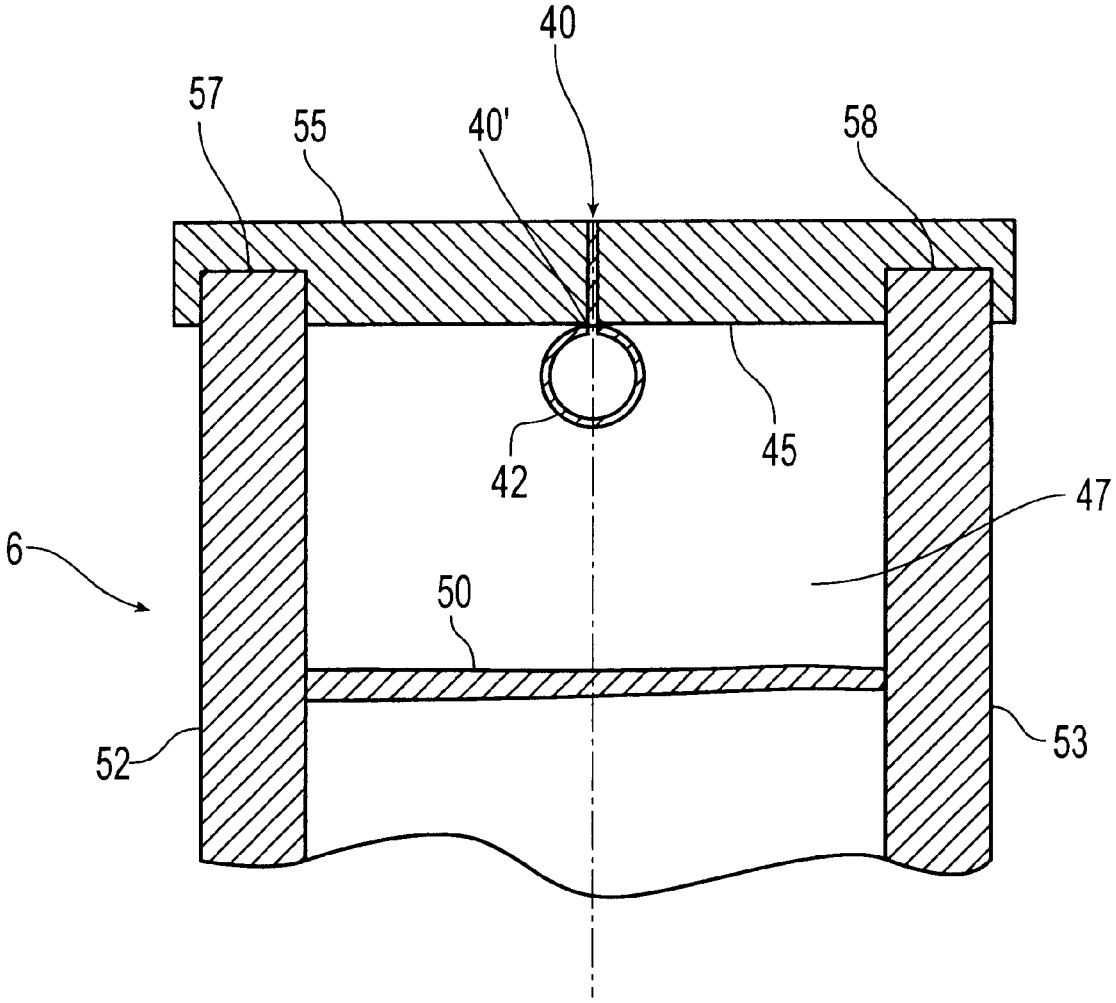
FIG. 5 illustrates a cross-sectional view along a horizontal plane of a disk of FIG. 4 according to the invention.

The disks 6 may be formed by any method known to those in the art, for example, by molding. The disks 6 may also be formed of one or more pieces of one or more types of materials. In the embodiment depicted in FIG. 5, the disk is formed of two plates 52, 53 having the same shape as each other and as described above for the disks. The plates 52, 53 may have a hollow area 47 therebetween to permit pressurized gas input to the disk 6 and output through the holes 40, although in the embodiment where the tubing 42 is disposed circumferentially around the edge the hollow area 47 may be negligible in size or even avoided altogether if the tubing 47 can be properly positioned otherwise. The plates may be made of any suitable material having sufficient strength to maintain a substantially constant shape, preferably one or more thermoplastic or elastic materials. It is also preferred that the plates 52, 53 be made of a clear material so that the operator of the device can more easily monitor the powdering device operation and intervene if any problems should arise during operation thereof. Thus, a more preferred material for the plates 52, 53 of each disk includes acrylic, LEXAN, PLEXIGLASS, or the like. LEXAN is commercially available plastic from General Electric Company of Fairfield, Conn. Although the plates 52, 53 may be positioned at an angle to each other, this may hinder powder deposition. Thus, the plates are preferably maintained in a position substantially parallel to each other. This is accomplished by "capping" the plates 52, 53 with an edge 55 having sufficient flexibility to be disposed around the rims 57, 58 of the plates 52, 53. The edge 55 should preferably provide a substantially gas-tight contact with the plates 52, 53 to prevent gas from escaping the hollow area 47, particularly if the hollow area is pressurized. In the embodiment depicted in FIG. 5, the edge 55 has grooves therein that correspond to the plate rims 57, 58 so that the edge forms a "cap" on the rims to maintain the plates 52, 53 in a substantially fixed position. The edge 55 may be made of any suitable material that permits holes to be provided in the edges thereof, preferably one or more thermoplastic or elastic materials, and more preferably including polypropylene. The substrate (not depicted in FIG. 5) will pass adjacent and above the edge 55 as the edge is depicted in FIG. 5. It should be understood, of course, that the disks 6 may be constructed in any manner described herein or known to those of ordinary skill in the art that permits the disks 6 to act as a guide for the substrate as it passes through the powdering device. For example, in another embodiment (not shown) where the tubing 42 of FIG. 5 is passed circumferentially around the edge 55, only one plate 52 (or 53) is required since the tubing 42 avoids the need to have a hollow area within the disk 6. In another embodiment (also not shown), the tubing 42 may be integrally formed as a hollow chamber disposed circumferentially within the edge 55 itself, such as by extrusion or molding.

Referring again to FIG. 4, the holes 40 in the edge of each disk 6 are generally spaced apart at about 0.25 to 3 inches, preferably about 0.5 to 2 inches, and more preferably about 0.75 to 1.5 inches apart to ensure that the appropriate amount of gas is released to force and maintain the substrate away from the disks 6. The escaping gas provides an air film that maintains the substrate at a distance from about 0.001 to 0.3 inches, preferably from about 0.01 to 0.25 inches, and more preferably from about 0.05 to 0.2 inches away from the disks 6. The holes should have a diameter from about 0.001 to 0.5 inches, preferably 0.005 to 0.1 inches, and more preferably about 0.01 to 0.09 inches. The gas, which is preferably air, is provided from a gas source that escapes from the holes 40 at a sufficient velocity to push the substrate 1 off the edge of each disk 6. The gas pressure for release from the holes 40 is generally from about 0.001 psi to 150 psi, preferably from about 1 psi to 120 psi, and more preferably from about 15 psi to 100 psi. Suitable gas pressure will depend upon the tension on the web of substrate 1, and may be readily determined by one of ordinary skill in the art. The gas then advantageously escapes into the adjacent contained area(s) 12, thereby inhibiting loose powder particles in the contained area(s) 12 from escaping that particular contained area 12 and from contacting the substrate anywhere outside that particular area 12. The maximum velocity for the gas is limited by the need to avoid: (a) tearing of the substrate; and (b) forcing powder particles too far away from each disk 6, which tends to leave blank areas on the substrate near the disks where the powder particles were unable to contact the ink on the substrate. Suitable gas velocities may be readily determined by those of ordinary skill in the art. Although the disks may rotate, they are preferably stationary since the substrate advantageously floats over the disks on the gas forced from the edges of each disk 6.

The number of disks 6, and distance between each, may be adjusted over the length of the rollers as necessary to provide one or more contained areas 12 that will permit powder to be retained by the wet ink on the substrate, thus forming a powdered area that may be subsequently heated to form the thermographic print on the substrate. For example, the disk 6 closest to each end of the rollers may be adjusted depending upon the substrate width so that the outermost edge of each disk is positioned correspondingly under each edge of the substrate 1. Thus, at least two disks 6 are used for the edges of the substrate 1, although more disks may be added in any location along the rollers if it is desired to deposit different powders on different areas of the substrate. This flexibility in adjusting the disks 6 advantageously permits different color or quality powder particles to be used in each contained area 12. The powder hopper 7 of FIGS. 1 and 2 may release such different color and/or quality powders into the different contained areas 6, and the disks 6 will completely prevent any of the powder from migrating to a different contained area 12. It should be understood, of course, that suitable thermographic powders may be of any size or quality used in thermographic printing, from small particles up to the size of those described in U.S. Pat. No. 5,699,743, which is incorporated herein by express reference thereto. The powder may also include any of a variety of suitable conventional fillers used in thermographic printing, such as glitter, pearlescent pigment, sand, metallic pigment, and the like.

After leaving the powdering device 4, the substrate 1 passes through a heater 10 as depicted in FIG. 1. The heater may be any conventional heater, although preferably the heater is height adjustable. When the substrate is in motion at the full speed described above, the height of the heater is reduced to move it closer to the substrate for greater heat transfer. The temperature of the substrate is typically raised to a maximum of about 200° F. to no greater than 450° F., preferably from about 250° F. to 375° F., and more preferably from about 300° F. to 350° F., to avoid igniting the substrate, although the actual temperature will depend upon the type and size of powder particle, the type of substrate and speed thereof, and the desired height of the finished thermographic product. Suitable temperatures may be readily determined by those of ordinary skill in the art when considered in combination with the disclosure herein. When the substrate is moving at slower speeds, the heater height is increased proportionally relative to the substrate speed to provide the same heat transfer as at higher speeds. This height adjustment also permits the heater to be raised far enough away from the substrate to avoid any burning thereof when the substrate is stopped.

Conventional heating typically occurs by radiation heating of the substrate, with the heat then being conducted through the substrate to the substrate portions under the ink and powder. This occurs because the energy used for heating is typically selected to have a wavelength to match the absorption of the substrate, and the powder and ink typically have a different absorption wavelength. Thus, it is preferable to dispose the heating elements below the substrate so that the powder does not "block" the radiation. In this manner, the heat may be applied more evenly across the substrate, which permits less energy to be used and avoids overheating portions of the substrate that are not covered by powder in an attempt to heat and fuse the powder.

It is also preferred to have the substrate as close as possible to the heat source, which also reduces the energy required for heating and permits the more rapid heating required when passing the substrate through the heater at the high speeds achieved by the present invention. Thus, in a preferred embodiment, the substrate passes through the heater directly in contact with a refractory surface that forms part of the heater to decrease the distance from the heating coils or energy source to the substrate. Suitable distance for an energy source should thus be from about 0.1 to 2 inches, preferably 0.12 to 0.3 inches from the surface of the substrate in this embodiment. It should be understood, however, that these are various preferred embodiments and that any conventional heating mechanism may adapted for use with the invention.

It should be understood that the terms "air" and "gas," as used herein, are interchangeable and mean any suitable gas phase component that does not react chemically with the powder, substrate, or powdering device. Air is preferred but inert gases or mixtures thereon can be used, if desired.

Although the preferred embodiment is disclosed with the use of an ink as the powder adhering liquid, one of ordinary skill in the art will readily understand that other liquids such as adhesives or glues, shellac, paints and the like can be used, the only limitation being that such liquids are sufficiently moist or tacky so that the powder adhered thereto and that the liquid can be dried or cured by heating or drying operations.

Figure 6:
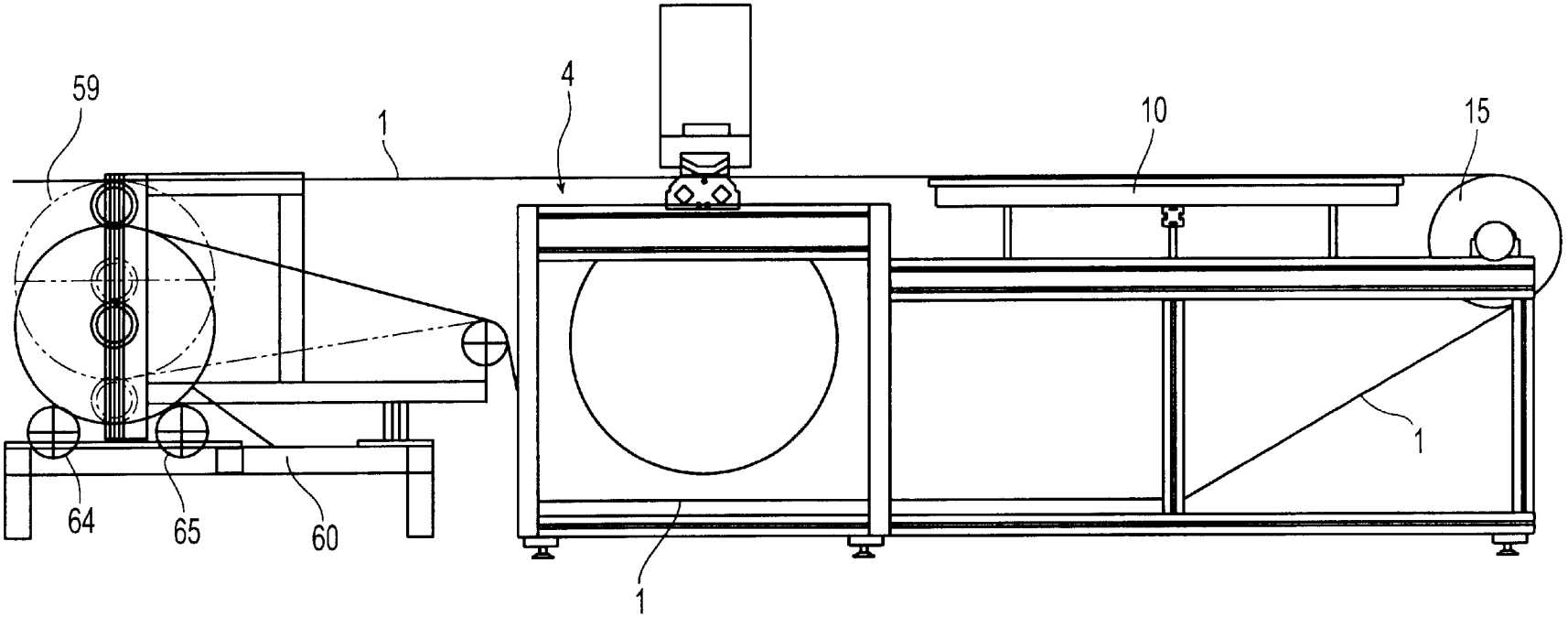
FIG. 6 illustrates a view of a feed roll and rewind roll in one embodiment of the invention for facilitating continuous operation of the printing apparatus.

After the substrate is dried and cooled, any of a number of conventional post-processing operations can be conducted. FIG. 6 depicts the substrate being fed from a feed roller 59, passing through the powdering apparatus 4, heater 10, and cooler 15, with the final product substrate 1 being returned to be taken up on a rewind spool 60, also known as a take-up roll, to provide a continuous web of final product immediately after passing through the cooler 15. Alternatively, a variety of additional operations not depicted may be performed after the substrate 1 leaves the cooler 15, such as cutting the web into discrete sheets and then collecting the sheets in stacks or reams rather than returning them for take up on a rewind spool 60. If desired, the sheets can be folded and, if necessary, collated prior to being collected. In short, any substrate handling operation conventionally used in printing or thermographic printing may also be combined with the present invention to achieve high speed thermographic printing. Persons of ordinary skill in the art of handling paper webs are aware of all these operations so that they need not be further described herein.

While the term "continuous" is intended to mean the application of the powder to the entire length of a roll or web of the substrate, there are other known techniques for changing such rolls "on the fly" so that a fully continuous process can be achieved, such as by splicing and/or use of an accumulator. This is conventionally done with an arrangement of multiple rollers and rolls of substrate with a feeder roll of substrate to be fed into the printing apparatus and a take-up roll to receive and re-roll the substrate after it has been thermographically printed upon, as depicted in FIG. 6. In one embodiment depicted in FIG. 6, the take-up roll is moved by powered rollers 64, 65 to pull the substrate web 1 through the entire apparatus. Continuous printing is well known to those of ordinary skill in the printing industry.

It is to be recognized and understood that the invention is not to be limited to the exact configuration as illustrated and described herein. For example, it should be apparent that a variety of suitable arrangements and materials would be suitable for use in the apparatus according to the Detailed Description of the Invention. For example, when the powder is introduced as a fluidized stream, it could be introduced into the side of the disk rather than the top since it is not being gravity fed. Accordingly, all expedient modifications readily attainable by one of ordinary skill in the art from the disclosure set forth herein are deemed to be within the spirit and scope of the present claims.

What is claimed is:

1. A thermographic printing apparatus comprising:

a header assembly having at least two rollers for transporting through the apparatus a substrate having first and second sides, two edges, and a powder adhering liquid located on the first side thereof, wherein the rollers contact the substrate on the second side thereof;

at least two disks each having an edge for transferring the substrate between the rollers, wherein the disks position the substrate adjacent the edge of each disk to provide at least one substantially contained area between the disks and substrate; and a powder supply for providing powder particles into the at least one contained area for application to the first side of the substrate, whereby an amount of the particles provided into the contained areas adheres to the liquid on the substrate.

2. The apparatus of claim 1, further comprising a gas supply in the header assembly directed at the first side of the substrate for removing excess powder particles from the substrate to avoid smearing of the liquid or powder particles on the substrate.

3. The apparatus of claim 1, wherein the header assembly is configured to permit the substrate to move continuously through the apparatus.

4. The apparatus of claim 1, wherein each edge of the substrate is positioned adjacent a corresponding edge of each disk.

5. The apparatus of claim 1, further comprising at least one additional disk located between the two disks to separate the contained area into at least two separate substantially contained areas to facilitate application of different powder types onto different portions of the substrate.

6. The apparatus of claim 1, wherein the edge of each disk includes holes therein to emit a gas at a sufficient velocity to prevent direct contact of the substrate with the disk edge.

7. The apparatus of claim 6, wherein the disk edge holes have a diameter from about 0.001 to 0.5 inches and are spaced apart by about 0.25 to 3 inches.

8. The apparatus of claim 7, wherein the holes have a diameter from about 0.01 to 0.05 inches and are spaced apart by about 0.75 to 1.5 inches.

9. The apparatus of claim 6, wherein the disks are substantially circular.

10. The apparatus of claim 9, wherein each disk has a diameter from about 12 to 60 inches and a thickness from about 0.25 to 6 inches.

11. The apparatus of claim 9, wherein each disk has a diameter from about 24 to 36 inches and a thickness from about 1 to 3 inches.

12. The apparatus of claim 6, wherein the gas is maintained at a pressure from about 15 psi to 120 psi for release from the holes.

13. The apparatus of claim 1, further comprising a heating device located at a distance from the substrate having particles of powder and powder adhering liquid thereon, wherein the heating device is capable of adjustment to increase the distance from the substrate having a speed as the substrate speed is slowed, which inhibits burning of the substrate and imparts a substantially constant amount of heat to the substrate to melt and fuse the powder particles thereon.

14. The apparatus of claim 13, wherein the heater contains a heat source disposed at a distance from about 0.1 to 2 inches from the substrate and the substrate is disposed between the powder and the heater.

15. The apparatus of claim 13, wherein the powder adhering liquid is an ink which is capable of drying as the substrate passes through the heating device.

16. The apparatus of claim 1, wherein the header assembly has an intake roller and an output roller and the intake roller is disposed at an angle from about 1 to 80 degrees above the horizontal relative to the output roller to inhibit the loss of powder supply.

17. The apparatus of claim 1, further comprising at least one feed roller capable of providing substrate to the header assembly in a continuous fashion or a rewind spool capable of continuously receiving and rolling the substrate.

18. A thermographic printing apparatus comprising:

means for transporting a substrate having first and second sides and wet ink on the first side thereof, wherein the means for transporting contacts the substrate on the second side of the substrate;

means for positioning the substrate in the apparatus to provide at least one substantially contained area between the means for positioning and the substrate, wherein the means for positioning does not contact the substrate; and means for providing powder particles for application to the first side of the substrate capable of adhering an amount of the particles to the wet ink on the substrate.

19. The apparatus of claim 18, wherein the means for positioning comprises at least two substantially circular disks having holes for emitting gas spaced around the circumferential edge thereof.

20. The apparatus of claim 18, further comprising means for removing excess powder particles from the substrate sufficient to inhibit smearing of the wet ink or powder particles on the substrate.

21. A method of thermographic printing which comprises:

transporting a substrate having first and second sides, two edges, and a powder adhering liquid on the first side thereof from a continuous web along a path;

providing powder particles onto at least a portion of the first side of the substrate, whereby at least some of the powder particles adhere to the liquid on the substrate; and circulating the powder particles that do not adhere to the liquid on the first portion of the substrate for application to further portions of the substrate, wherein the substrate is directed along a substantially circular path with the first side of the substrate that contains the powder adhering liquid positioned inside of the circular path and the non-adhering powder particles are positioned along the path adjacent the substrate for deposition onto further portions thereof.

22. The method of claim 21 wherein the powder adhering liquid is an ink and which further comprises removing excess powder particles by transporting the substrate before the powder coated substrate is heated.

23. The method of claim 21 wherein the transporting occurs at a speed from about 400 to 2000 feet/minute.

* * * * *

UNITED STATES PATENT AND TRADEMARK OFFICE

CERTIFICATE OF CORRECTION

PATENT NO. : 6,119,598

DATED : September 19, 2000

INVENTOR(S) : Michael G. REYNOLDS
Anthony F. URGOLA

It is certified that error appears in the above-identified patent and that said Letters Patent is hereby corrected as shown below:

On the title page

The order of the names of the inventors should be as follows:

1. Anthony F. URGOLA
2. Michael G. REYNOLDS

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*